US008757210B2

(12) United States Patent
Tang et al.

(10) Patent No.: US 8,757,210 B2
(45) Date of Patent: Jun. 24, 2014

(54) CONSTANT TEMPERATURE OUTLET STRUCTURE

(75) Inventors: Shaohua Tang, Qingdao (CN); Wuqin Gao, Qingdao (CN); Xiaodong Li, Qingdao (CN)

(73) Assignee: Globe Union Industrial Corp., Taichung (TW)

( * ) Notice: Subject to any disclaimer, the term of this patent is extended or adjusted under 35 U.S.C. 154(b) by 117 days.

(21) Appl. No.: 13/437,728

(22) Filed: Apr. 2, 2012

(65) Prior Publication Data

US 2013/0255811 A1 Oct. 3, 2013

(51) Int. Cl.
*E03C 1/01* (2006.01)
*E03C 1/042* (2006.01)

(52) U.S. Cl.
USPC ..... 137/801

(58) Field of Classification Search
CPC ..... E03C 1/042; E03C 1/08; E03C 1/0404; F16K 1/12; A47K 5/06
USPC ..... 137/801
See application file for complete search history.

(56) References Cited

U.S. PATENT DOCUMENTS

| | | | | | |
|---|---|---|---|---|---|
| 3,079,093 | A * | 2/1963 | Bellows | 239/314 |
| 3,779,278 | A * | 12/1973 | Hill | 137/597 |
| 4,084,620 | A * | 4/1978 | Bucknell et al. | 137/801 |
| 6,267,145 | B1 * | 7/2001 | Sun | 137/801 |
| 6,301,727 | B1 * | 10/2001 | Bertrand et al. | 4/678 |
| 6,334,463 | B1 * | 1/2002 | Lee | 137/801 |
| 8,376,249 | B2 * | 2/2013 | Huang | 239/587.5 |
| 8,424,559 | B2 * | 4/2013 | Huang | 137/360 |
| 2002/0133873 | A1 * | 9/2002 | Donath et al. | 4/675 |
| 2009/0277520 | A1 * | 11/2009 | Wang | 137/801 |
| 2010/0139796 | A1 * | 6/2010 | DeVries et al. | 137/801 |
| 2010/0252115 | A1 * | 10/2010 | Bassols | 137/1 |

* cited by examiner

*Primary Examiner* — John K Fristoe, Jr.
*Assistant Examiner* — Frederick D Soski
(74) *Attorney, Agent, or Firm* — Che-Yang Chen; Law Office of Michael Chen

(57) ABSTRACT

A constant temperature outlet structure is disclosed. A wall is disposed inside a housing of the constant temperature outlet structure. A cavity and an outlet pipeline are separated by the wall. A hose joint is disposed on the wall. A first hole of the housing is disposed corresponding to the outlet pipeline and a second hole is disposed at the wall. Two ends of the second hole are respectively connecting the cavity and the first hole. Thereby, the electroplating solution accumulated in the cavity surrounding the hose joint can be flowed downwardly from the second hole, through the first hole, and then discharged when the constant temperature outlet structure is slantwise hanged.

7 Claims, 6 Drawing Sheets

CONSTANT TEMPERATURE OUTLET STRUCTURE

FIELD OF THE INVENTION

The present invention generally relates to a constant temperature outlet structure of a faucet, and more particularly to a constant temperature outlet structure capable of easily discharging the planting solution while electroplating.

BACKGROUND OF THE INVENTION

The traditional faucet is generally made by Cu or Zn because Cu and Zn are easily rusted while coming into contact with water. To keep the quality of water and extend the life time of the faucet, the components of the faucet are generally electroplated.

Please refer to FIG. 1, a constant temperature outlet 1 of the faucet comprises a housing 11 having a cavity 12 thereinside. The housing 11 are generally a streamline form having an end with larger caliber and the other end with smaller caliber. A wall 13 is disposed inside the end with small caliber and used for separating the cavity 12. A hose joint 14 is disposed on the wall 13 to connect a hose (not shown) for providing water. An outlet pipeline 15 is disposed at the other side of the wall 13 for discharging water. A first hole 16 is disposed at the housing 11 corresponding to the outlet pipeline 15 for providing a pull rod (not shown) with open/close functions to be passed through. In addition, a lug 17 is disposed at inner surface of the housing 11.

Please refer to FIG. 2, the lug 17 is hooked by a hanger 2 while electroplating the constant temperature outlet 1, so that the downward end of the pipeline 15 is immersed in the electroplating solution 30 of the electroplating tank 3 to perform the electroplating process.

After finishing electroplating process, the hanger 2 is raised and the constant temperature outlet 1 is lifted to leave the electroplating solution. Meanwhile, the electroplating solution remained at the cavity 12 and the pipeline outlet 15 is discharged downwardly, but a trough-shaped space (shown as FIG. 3) is formed by the wall 13 and the hose joint 14 and the accumulated electroplating solution will be passed to the follow-up process to contaminate the electroplating chemicals of the follow-up process and further to effect the yield rate. Moreover, each constant temperature outlet 1 takes 15~20 ml of electroplating solution away. The loss of the electroplating solution results in the imbalance of the electroplating solution 30 in the electroplating tank 3 and needs to supplement additional main salt to keep balance that will increase additional costs. The taken-away electroplating solution will make the sewage treatment much harder and increase the treatment cost, and further increase the total costs.

After patent search, the issued utility model patent CN2384071Y has been disclosed a water outlet body for a water tap, which comprises casing. The inner part of the casing is provided with a downward, expanded and hollow pipeline zone, and a water pipe joint is arranged in the pipeline zone. A water outlet zone is formed on the upper side of the water pipe joint, and the adjacent side of the water outlet zone is a movable sheet installing zone of a switch. The utility model is characterized in that the point on the casing adjacent to the water pipe joint is provided with at least one through air exhausting hole, the air squeezed by electric base solutions is discharged on the solution face, and the whole is completely electroplated. But the through air exhausting hole is radially passed through the casing. If it is used for the constant temperature outlet hanged slantwise as mentioned before, the remained electroplating solution is not completely discharged and the deterioration of adhesion is caused between the casing and an electroplating layer formed on the casing. It will be easily rusted after long use. Therefore, the recent constant temperature outlet needs to be improved.

Therefore, the secondary objective of this invention is how to design a faucet with a mixed water control valve which is adapting to different arrangements of inlet pipes of cold water and hot water.

SUMMARY OF THE INVENTION

An objective of this invention is providing a constant temperature outlet structure, which makes the electroplating solution be discharged completely and not accumulated by installing the second hole of the wall to connect the cavity and the first hole to achieve the effects of improving yield rate and cost down.

To achieve above objectives, a constant temperature outlet structure is disclosed and comprises a housing having a wall disposed thereinside, a cavity and an outlet pipeline are separated by the wall, a hose joint is disposed on the wall, a first hole of the housing is disposed corresponding to the outlet pipeline, and a second hole is disposed at the wall and two ends of the second hole are respectively connecting the cavity and the first hole.

Since the second hole is disposed at the lower portion close to the centerline for hanging the constant temperature outlet and the second hole is connecting the cavity and the first hole, the electroplating solution accumulated around the hose joint is capable of discharging downwardly through the first hole, so that the electroplating solution is discharged completely and not accumulated in the entire internal of the constant temperature outlet. And there is not necessary to add and process the electroplating solution, and further the effect of cost down is achieved.

Preferably, a connecting portion is disposed between the wall and the first hole, and the second hole is disposed inside the connecting portion.

Preferably, an extending direction of the cavity and an extending direction of the outlet pipeline are perpendicular to each other.

Preferably, an extending direction of the hose joint and an extending direction of the first hole are perpendicular to each other.

Preferably, the first hole is located at one side of the outlet pipeline which is far away from an outlet of the outlet pipeline.

Preferably, the second hole is located at one side of the outlet pipeline which is far away from an outlet of the outlet pipeline.

Preferably, one side of the housing which is far away from the cavity is slantwise extended toward a direction which is far away from the cavity.

Compared to prior art, the electroplating solution is not capable of being accumulated in the cavity of the constant temperature outlet structure of this invention because of the installation of the second hole, so as to achieve the effects of improving yield rate and cost down.

Further features and advantages of the present invention will become apparent to those of skill in the art in view of the detailed description of preferred embodiments which follows, when considered together with the attached drawings and claims.

BRIEF DESCRIPTION OF THE DRAWINGS

All the objects, advantages, and novel features of the invention will become more apparent from the following detailed descriptions when taken in conjunction with the accompanying drawings.

DESCRIPTION OF THE PREFERRED EMBODIMENT

Figure 1:
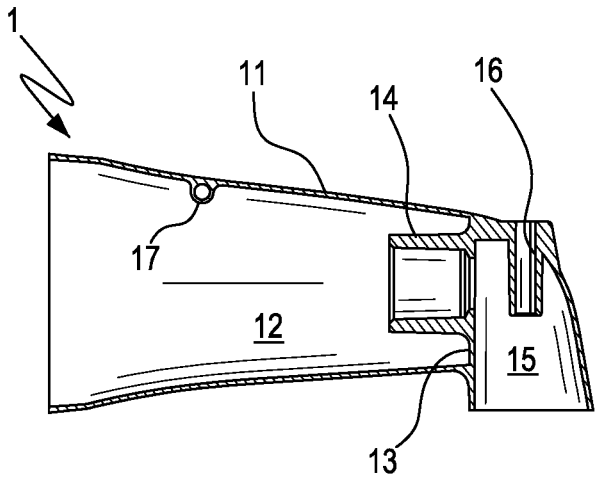
FIG. 1 (Prior art)
FIG. 1 illustrates a schematic diagram of a prior art constant outlet structure.
Figure 2:
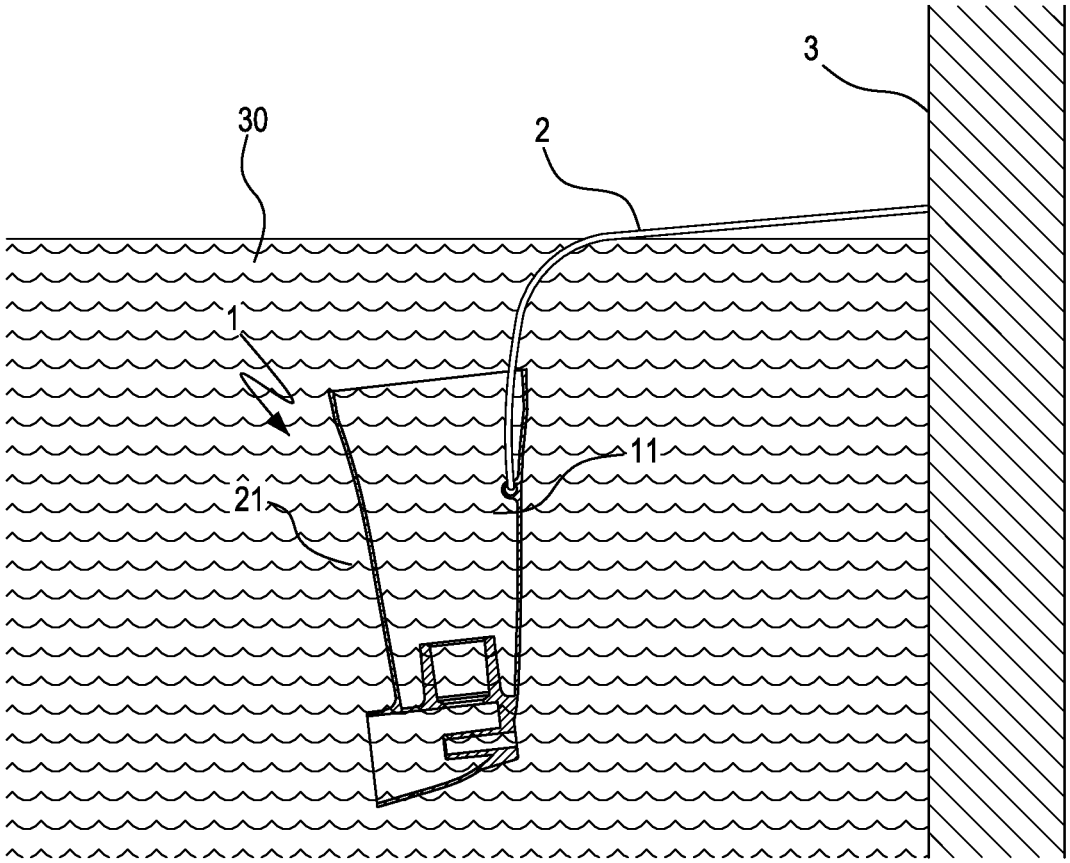
FIG. 2 (Prior art)
FIG. 2 illustrates a schematic diagram of the prior art constant outlet structure while electroplating.
Figure 3:
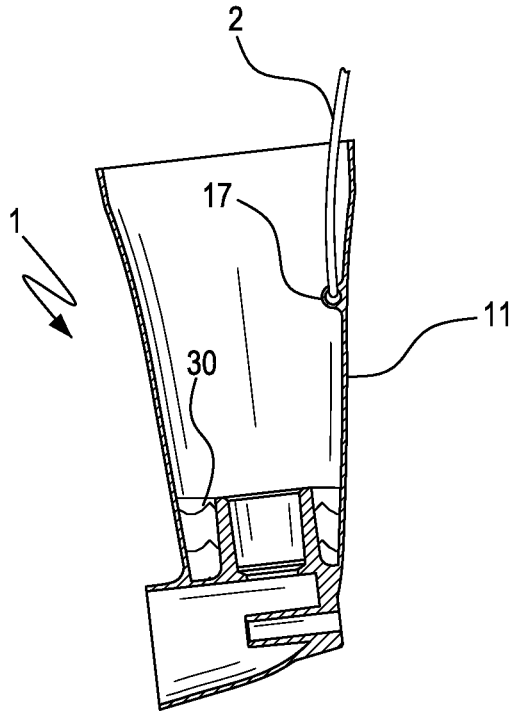
FIG. 3 (Prior art)
FIG. 3 illustrates a schematic diagram which electroplating solution is accumulated in the prior art constant outlet structure.

Referring now to the drawings where like characteristics and features among the various figures are denoted by like reference characters.

Figure 4:
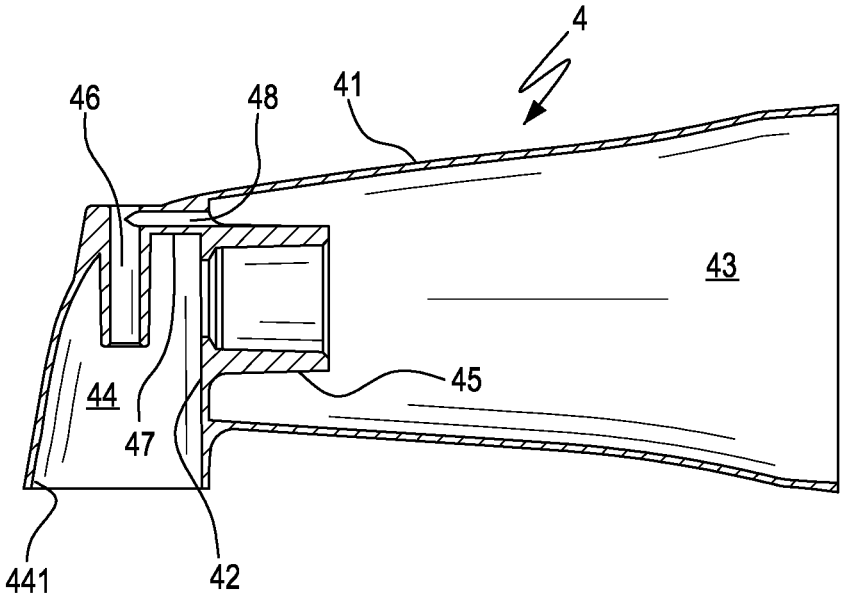
FIG. 4 illustrates a sectional view of a constant outlet structure in accordance with this invention.
Figure 5:
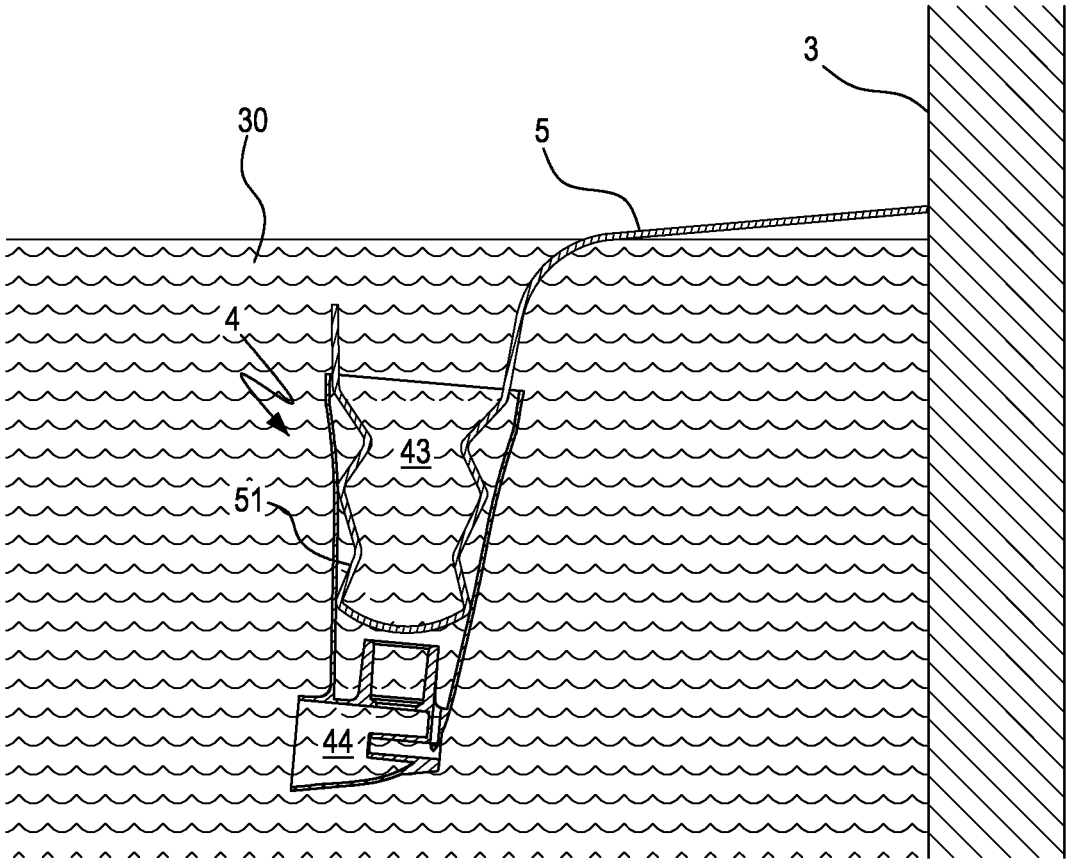
FIG. 5 illustrates a schematic diagram of the constant outlet structure in accordance with this invention which is hanged by a hanger while electroplating.
Figure 6:
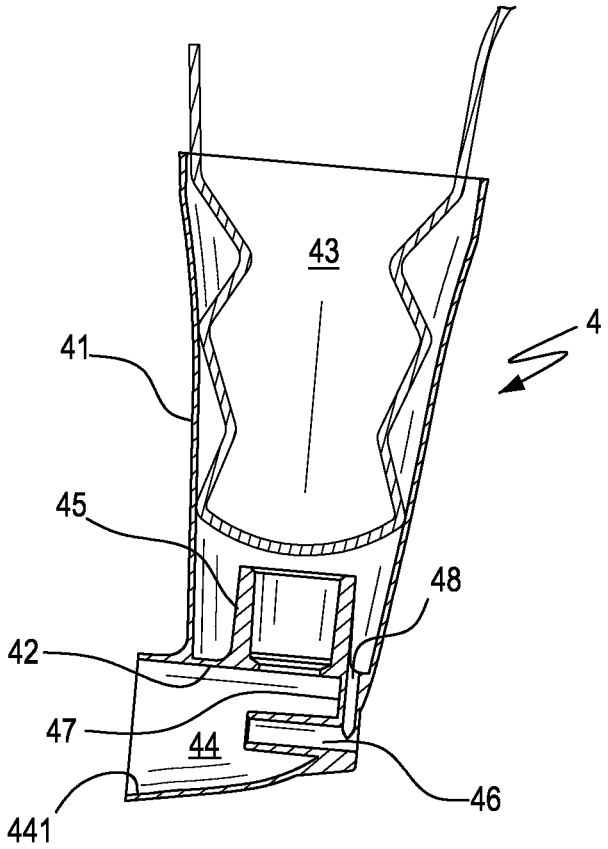
FIG. 6 illustrates a schematic diagram of the constant outlet structure in accordance with this invention which is hanged by the hanger.

Please refer to FIGS. 4 to 6, wherein FIG. 4 illustrates a sectional view of a constant outlet structure in accordance with this invention, FIG. 5 illustrates a schematic diagram of the constant outlet structure in accordance with this invention which is hanged by a hanger while electroplating, FIG. 6 illustrates a schematic diagram of the constant outlet structure in accordance with this invention which is hanged by the hanger.

The constant temperature outlet structure 4 of this invention comprises a housing 41 having a wall 42 disposed thereinside. A cavity 43 and an outlet pipeline 44 are formed in the housing and separated by the wall 42. An extending direction of the cavity 43 and an extending direction of the outlet pipeline 44 are perpendicular to each other, and one side of the housing 41 which is far away from the cavity 43 is slantwise extended toward a direction which is far away from the cavity 43. A hose joint 45 is disposed on the wall 42, and the housing 41 is including a first hole 46 which is disposed corresponding to the outlet pipeline 44. The first hole 46 is located at one side of the outlet pipeline which is far away from an outlet 441 of the outlet pipeline 44, and an extending direction of the hose joint 45 and an extending direction of the first hole 46 are perpendicular to each other. A connecting portion 47 is disposed between one side of the wall 42 which is far away from the outlet 441 and the first hole 46, and a second hole 48 is disposed at one side of the wall 42 which is far away from the outlet 441 of the outlet pipeline 44. The second hole 48 is passing through the wall 42 and the connecting portion 47, so that the second hole 48 is connecting the cavity 43 and the first hole 46.

Please refer to FIG. 5, when the constant temperature outlet structure 4 of this invention is in electroplating process, an elastic clipping portion 51 of a hanger 5 is wedged inside the cavity 43 to make one end of the outlet pipeline 44 be downward and slantwise (about 0 to 20 degree) immerged in the electroplating solution 30 of the electroplating tank 3 to perform the electroplating process.

Please refer to FIG. 6, since the thicker portion of entire constant temperature outlet structure 4 is massing at one side of the first hole which is far away from the outlet 441 of the pipeline 44 and so is the connecting portion 47, the second hole 48 is positioned there and passed through the wall 42 and the connecting portion 47, and then the first hole 46 while the entire constant temperature outlet structure 4 is slantwise (about 0 to 20 degree, and 5 degree is for example shown as FIG. 6) hanged by the hanger 5.

As a result, in the end of the electroplating process, when the constant temperature outlet structure 4 is raised and left the electroplating solution, the electroplating solution accumulated around the hose joint 45 is capable of being discharged downwardly from the second hole 48 and through the first hole, so that there is no electroplating solution accumulated inside the constant temperature outlet structure 4. The electroplating solution is not accumulated inside the constant temperature outlet structure 4, so that the electroplating solution in the electroplating tank is capable of maintaining balance to keep the yield rate of electroplating. And the main salt is not necessary to add additionally so as to saving the cost of processing the electroplating solution in follow-up process, and further to achieve the effects of improving yield rate and cost down.

In addition, since two ends of the second hole 48 are respectively connecting the cavity 43 and the first hole 46, there is no hole viewed from the appearance of the constant temperature outlet structure 4 and the two openings of the second hole 48 is not necessary to do any process. Therefore, it is able to save the cost of operating follow-up process and keep the appearance beautiful.

Although the invention has been explained in relation to its preferred embodiment, it is not used to limit the invention. It is to be to understood that many other possible modifications and variations can be made by those skilled in the art without departing from the spirit and scope of the invention as hereinafter claimed.

What is claimed is:

1. A constant temperature outlet structure, comprising a wall disposed inside a housing, a cavity and an outlet pipeline are separated by the wall, a hose joint is disposed on the wall, the hose joint having a hole connecting the outlet pipeline to the cavity thru the wall, a first conduit of the housing is disposed corresponding to the outlet pipeline, and a second conduit disposed at the wall, one end of the second conduit connecting to the cavity and the other end thereof intersecting the first conduit in a substantially perpendicular manner.

2. The constant temperature outlet structure as claimed in claim 1, wherein a connecting portion is disposed between the wall and the first conduit, and the second conduit is disposed inside the connecting portion.

3. The constant temperature outlet structure as claimed in claim 1, wherein an extending direction of the cavity and an extending direction of the outlet pipeline are perpendicular to each other.

4. The constant temperature outlet structure as claimed in claim 1, wherein an extending direction of the hose joint and an extending direction of the first conduit are perpendicular to each other.

5. The constant temperature outlet structure as claimed in claim 1, wherein the first conduit is located at one side of the outlet pipeline which is separated from an outlet of the outlet pipeline.

6. The constant temperature outlet structure as claimed in claim 1, wherein the second conduit is located at one side of the outlet pipeline which is separated from an outlet of the outlet pipeline.

7. The constant temperature outlet structure as claimed in claim 1, wherein one side of the housing slantwise extends toward a direction of the cavity.

* * * * *